US010024628B2

(12) United States Patent
Toner et al.

(10) Patent No.: US 10,024,628 B2
(45) Date of Patent: Jul. 17, 2018

(54) REAR SIGHT MOUNTING ASSEMBLY FOR A FIREARM

(71) Applicant: Sig Sauer, Inc., Newington, NH (US)

(72) Inventors: Sean P. Toner, Merrimack, NH (US); Keith Andrew Cornish, Barrington, NH (US); Robby Dwight Johnson, Barrington, NH (US); Matthew Alan Taylor, Barrington, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 15/709,611

(22) Filed: Sep. 20, 2017

(65) Prior Publication Data

US 2018/0087871 A1 Mar. 29, 2018

Related U.S. Application Data

(60) Provisional application No. 62/398,940, filed on Sep. 23, 2016.

(51) Int. Cl.
*F41G 1/16* (2006.01)

(52) U.S. Cl.
CPC ..... *F41G 1/16* (2013.01)

(58) Field of Classification Search
CPC ..... F41G 1/16; F41G 17/20; F41G 11/001–11/005
USPC ..... 42/111, 135–138
See application file for complete search history.

(56) References Cited

U.S. PATENT DOCUMENTS

| | | | | | |
|---|---|---|---|---|---|
| 3,495,339 | A * | 2/1970 | Elliason | F41G 1/26 | 42/137 |
| D254,680 | S * | 4/1980 | Behlert | D22/109 | |
| 4,200,989 | A * | 5/1980 | Brouthers | F41G 1/26 | 42/137 |
| 4,606,131 | A * | 8/1986 | Domian | F41G 1/16 | 42/137 |
| 4,628,611 | A * | 12/1986 | Ruffino | F41G 1/16 | 42/137 |
| 6,327,806 | B1 * | 12/2001 | Paige | F41G 1/30 | 42/113 |
| 7,946,074 | B2 * | 5/2011 | Nemec | F41G 1/01 | 42/113 |
| 8,832,983 | B1 * | 9/2014 | Wolf | F41A 3/12 | 42/16 |
| 8,893,422 | B2 * | 11/2014 | Wolf | F41A 3/12 | 42/111 |
| 9,062,936 | B2 * | 6/2015 | Zimmer | F41G 11/001 | |
| 9,303,955 | B2 * | 4/2016 | Jeung | F41G 1/30 | |
| 9,410,770 | B2 * | 8/2016 | Zimmer | F41G 11/001 | |
| 9,423,212 | B2 * | 8/2016 | Campean | F41G 1/18 | |
| 9,506,726 | B2 * | 11/2016 | Wolf | F41G 1/26 | |

(Continued)

*Primary Examiner* — Joshua E Freeman
(74) *Attorney, Agent, or Firm* — Finch & Maloney PLLC

(57) ABSTRACT

A firearm slide includes a mounting plate that is removably connected to a planar mounting surface of the firearm slide. A rear sight is removably attached to the mounting plate so that different types or styles of rear sights may be used with the firearm. Upon removing the mounting plate itself, various mounting features defined in the planar mounting surface of the slide are exposed. These mounting features can be used to attach any of a variety of accessories (whether a telescopic sight, a red dot sight, a light, or other accessory) directly to the exposed planar mounting surface of the slide.

13 Claims, 6 Drawing Sheets

(56) References Cited

U.S. PATENT DOCUMENTS

| | | | | |
|---|---|---|---|---|
| 9,587,911 | B2 * | 3/2017 | Wolf | F41G 1/16 |
| 9,696,114 | B1 * | 7/2017 | Cabrera | F41G 1/17 |
| 9,863,740 | B2 * | 1/2018 | Wolf | F41G 1/01 |
| 9,869,526 | B1 * | 1/2018 | Cheng | F41G 1/345 |
| 2008/0092424 | A1 * | 4/2008 | Keng | F41G 1/18 42/137 |
| 2014/0053445 | A1 * | 2/2014 | Wolf | F41A 3/12 42/14 |
| 2014/0230305 | A1 * | 8/2014 | Zimmer | F41G 11/001 42/111 |
| 2015/0198415 | A1 * | 7/2015 | Campean | F41G 1/18 42/137 |
| 2015/0241175 | A1 * | 8/2015 | Wolf | F41G 11/005 42/124 |
| 2016/0223291 | A1 * | 8/2016 | Wolf | F41G 1/16 |
| 2017/0059277 | A1 * | 3/2017 | Justice | F41G 11/003 |
| 2018/0017356 | A1 * | 1/2018 | Cabrera | F41G 1/17 |

* cited by examiner

REAR SIGHT MOUNTING ASSEMBLY FOR A FIREARM

TECHNICAL FIELD

The present disclosure relates generally firearm sights. Specifically, the present disclosure relates to a rear sight mounting assembly for a firearm.

BACKGROUND

Simple optical sights (also colloquially known as "iron sights") have long been used to aim firearms. Iron sights typically have two components: a rear sight that is between the user and the front sight, and a front sight that is between the rear sight and the opening at the end of the firearm barrel. One configuration of an iron sight is an "open sight" that includes a notch formed in the rear sight. This notch is aligned with a post on the front sight, both of which are aligned with a target to aim the firearm. An "aperture sight" is similar to the open sight except a circular hole is used as a rear sight, rather than a notch.

Some iron sights include mechanisms to adjust one or both of the rear sight and the front sight. These adjustment mechanisms can improve the aiming accuracy of the firearm for situations in which there is a difference in elevation between the firearm user and the target, or for situations in which wind may affect the trajectory of a fired projectile. However, regardless of whether or not an iron sight includes mechanisms to make these adjustments, iron sights are often integrated with (i.e., not removable from) the firearm.

SUMMARY

One example of the present disclosure includes a firearm. The firearm includes a barrel; a firing chamber in mechanical communication with the barrel; a slide disposed over the barrel and firing chamber, where the slide has a rear end and a front end opposite the rear end. The slide also includes a planar mounting surface having a first end, and a second end opposite the first end, the first end of the planar mounting surface at the rear end of the slide and the second end of the planar mounting surface between the rear end of the slide and the front end of the slide. The slide includes at least two mounting features defined by the planar mounting surface. The slide includes a mounting pocket defined by the slide, the mounting pocket proximate to the second end of the planar mounting surface. The firearm also includes a mounting plate that further includes, a first end defining a sight mounting slot, the first end disposed at the first end of the planar mounting surface and a second end opposite the first end, the second end comprising a forward mounting tab configured to mount within the mounting pocket defined by the slide at the second end of the planar mounting surface.

In one embodiment, a length of the planar mounting surface between the first end and the second end is at least 30% of a length of the slide. In one embodiment, a length of the planar mounting surface between the first end and the second end is at least 33% of a length of the slide. In one embodiment, the firearm further includes a rear sight defining a sighting notch, the rear sight comprising a mounting surface configured to fit within the sight mounting slot of the first end of the mounting plate. In one embodiment, the rear sight mounting surface is a salient feature configured to fit within a corresponding recess defined by the first end of the mounting plate. In one embodiment, one mounting feature of the at least two mounting features defined by planar mounting surface includes at least one first threaded hole defined by the slide, the at least one first threaded hole corresponding to at least one through-hole defined by the mounting plate and also corresponding to at least one second threaded hole defined by the rear sight. In one embodiment, the firearm further includes at least one screw configured to be threaded through the corresponding at least one first threaded hole defined by the slide, disposed in the at least one through-hole, and threaded to the corresponding at least one second threaded hole defined by the rear sight. In one embodiment, one mounting feature of the at least two mounting features comprises an axial groove defined by the planar mounting surface of the slide, the axial groove extending between the first end of the planar mounting surface and the second end of the planar mounting surface. In one embodiment, the mounting plate further comprises an axial mounting rib extending between the first end of the mounting plate and the second end of the mounting plate along a longitudinal axis of the mounting plate.

One example of the present disclosure includes a rear sight mounting plate that includes a first end configured for mounting proximate to a rear end of a firearm, the first end defining a through-hole configured to receive a threaded portion of a screw and a sight mounting slot configured to receive rear sight. The rear sight mounting plate also includes a second end opposite the first end, the second end comprising a forward mounting tab configured to mount within a mounting pocket defined by a firearm slide.

In one embodiment, the rear sight mounting plate further comprising a rear sight configured to mount to the sight mounting slot defined by the first end of the rear sight mounting plate, the rear sight defining a sighting notch. In one embodiment, the rear sight mounting plate further includes an axial mounting rib extending along a longitudinal axis of the rear sight mounting plate and between the first end and the second end of the rear sight mounting plate.

One example of the present disclosure includes a firearm slide having a rear end and a front end, the firearm slide including a planar mounting surface having a first end, and a second end opposite the first end, the first end of the planar mounting surface at the rear end of the slide and the second end of the planar mounting surface between the rear end of the firearm slide and the front end of the firearm slide, at least two mounting features defined by the planar mounting surface, and a mounting pocket defined by the planar mounting surface, the mounting pocket proximate to the second end of the planar mounting surface.

In one embodiment, a first mounting feature of the at least two mounting features comprises an axial groove defined by the planar mounting surface and extending along a longitudinal axis of the firearm slide and between the first end and the second end of the planar mounting surface. In one embodiment, a length of the planar mounting surface between the first end and the second end is at least 30% of a length of the firearm slide. In one embodiment, a length of the planar mounting surface between the first end and the second end is at least 33% of a length of the firearm slide. In one embodiment, a second mounting feature of the at least two mounting features comprises at least one first threaded hole defined by the firearm slide disposed proximate to the rear end of the firearm slide.

BRIEF DESCRIPTION OF THE DRAWINGS

FIG. 3A' is a perspective view of an alternative configuration of a removable mounting plate partially mounted on a planar mounting surface of a firearm slide, in an embodiment.

The figures depict various embodiments of the present disclosure for purposes of illustration only. Numerous variations, configurations, and other embodiments will be apparent from the following detailed discussion.

DETAILED DESCRIPTION

Overview

As sighting technology has advanced, firearms have evolved to accommodate more sophisticated substitutes for iron sights (e.g., telescopic sights, laser ("red dot") sights). In some examples, these substitutes are integrated with the firearm. In other examples, the firearms include mounting features that allow a more sophisticated sighting system to be removably mounted on the firearm over the integrated iron sights.

Embodiments of the present disclosure include a firearm slide that includes a removable mounting plate (alternatively referred to herein as simply a "mounting plate" for brevity) and a removable rear sight. The removable rear sight is removably attached to the removable mounting plate so that different types or styles of rear sights may be interchanged with the firearm. Removing the mounting plate from the slide exposes various mounting features. These mounting features can be used to attach any of a variety of accessories (whether a telescopic sight, a red dot sight, a light, or other accessory), in addition to the mounting plate, directly to an exposed planar mounting surface on the slide of the firearm.

Benefits of embodiments described herein include improving the versatility of a firearm so that different configurations of rear sights can be used with a firearm. Furthermore, because of the removability of various elements of embodiments described below, a weight of the firearm is less than the weight conventionally experienced when a second sight is attached to a firearm while leaving a first, integrated, sight in place. Another advantage of embodiments described herein is the improved ability to repeatedly remove and replace any of a variety of previously calibrated sights (e.g., rear iron sight, red dot sight) with a reduced (or eliminated) amount of re-calibration needed upon re-attachment to the firearm.

Slide Assembly

Figure 1:
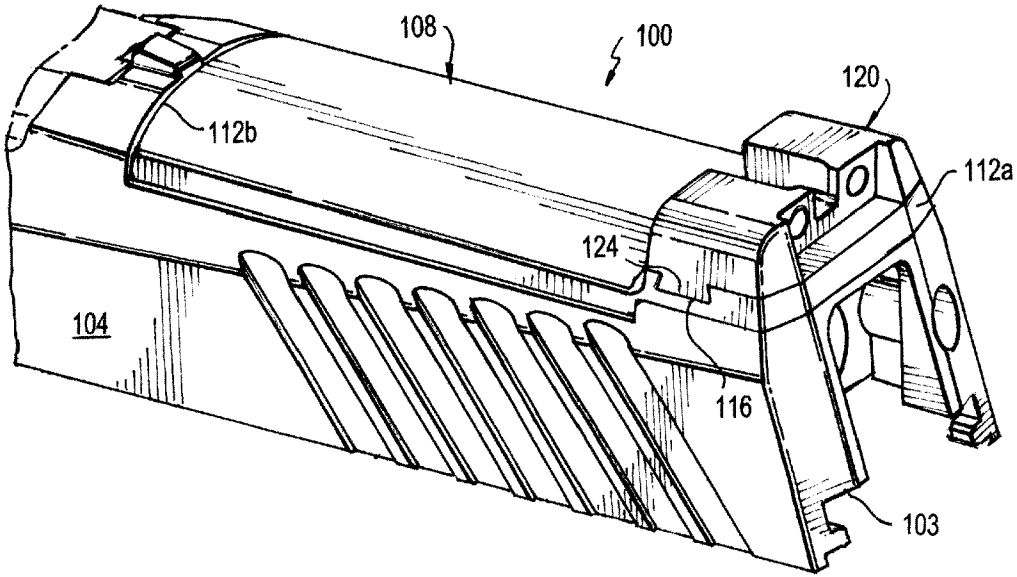
FIG. 1 is a perspective view of a firearm slide assembly that includes a firearm slide, a removable mounting plate and a removable rear sight, in an embodiment.

FIG. 1 is a perspective view of a firearm slide assembly 100 that includes a firearm slide 104, a removable mounting plate 108, and a removable rear sight 120, in an embodiment.

The firearm slide 104 (or simply "slide" for brevity) of the firearm slide assembly 100 houses various elements of the firearm, including a barrel, a firing chamber and a firing mechanism (which activates the propellant of a cartridge), and an ejector mechanism that ejects a spent casing from the firing chamber. The force generated upon activating the propellant of the cartridge generally translates the slide 104 toward a rear end of the firearm (i.e., toward the user). This translation of the slide 104 is used by semiautomatic firearms to eject the spent casing from the firing chamber, reset the firing mechanism, and load another cartridge into the firing chamber.

The firearm slide 104 provides a convenient substrate on which to attach various accessories. For example, as described above, some firearm slides 104 include mounting rails on which to attach lights, bayonets, telescopic sights, night vision sights, red dot sights, among other accessories. As also described above, a rear sight of an iron sight will often be placed at or proximate to a rear end 103 of the slide 104.

As will be explained below in more detail, embodiments of the slide 104 of the present disclosure include a planar mounting surface (not shown in FIG. 1) that defines various mounting features. Embodiments of the slide 104 of the present disclosure also define a mounting pocket (shown in FIGS. 4 and 5) and a threaded hole (shown in FIGS. 3A, 3A', 3B 5, and 8) at opposite ends of the slide 104. These are used to attach the removable mounting plate 108 to the slide 104. Both of these features will be described below in more detail.

Continuing with the embodiment depicted in FIG. 1, the planar mounting surface of the slide 104 (shown as various embodiments in FIGS. 2, 3A, 3A', and 3B, and described below) is covered by the removable mounting plate 108. The mounting plate 108 includes a first end 112*a* that is proximate to the rear end 103 of the slide (i.e., proximate to the user and opposite the front end of a slide that is either adjacent to or proximate to an open end of a barrel), and a second end 112*b* opposite the first end 112*a*. The mounting plate 108 defines a sight mounting slot 116 at the first end 112*a* of the mounting plate. As will be described below in more detail in the context of FIG. 6A, in one embodiment the sight mounting slot 116 is defined by the mounting plate 108 so that a separate rear sight 120 (or other type of accessory compatible with the mounting features) may be slid into and out of the sight mounting slot 116 via a mounting bar 124. As indicated above, this example feature, and other analogous features, adds versatility to the firearm because different styles and configurations of rear sights (or other types of accessories) that are compatible with the sight mounting slot 116 may be easily interchanged without requiring repeated calibrations.

Figure 6A:
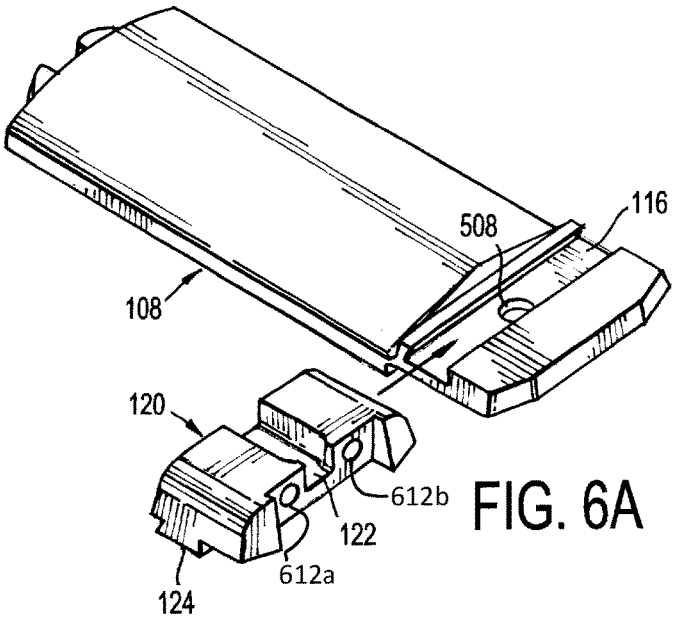
FIG. 6A is a perspective view of a removable mounting plate and a first rear sight configured to be removably attached to the removable mounting plate, in an embodiment.
Figure 6B:
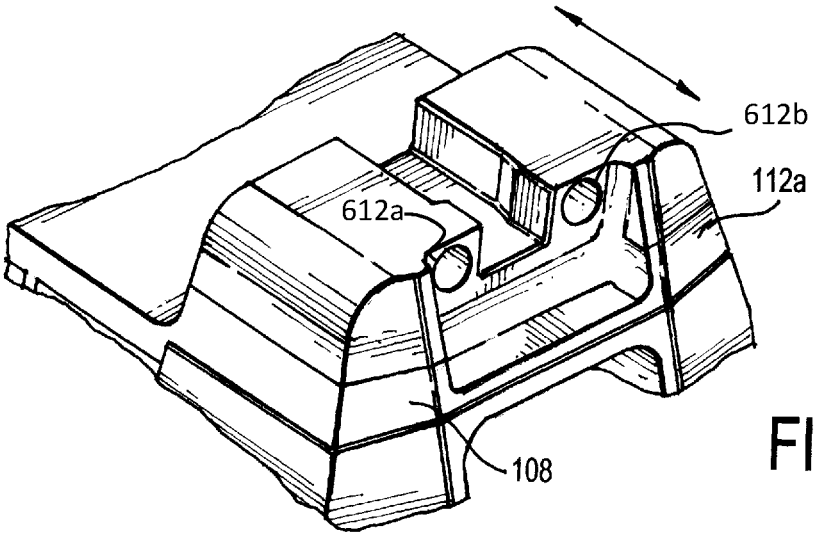
FIG. 6B is a perspective view of a removable mounting plate and a second rear sight configured to be removably attached to the removable mounting plate, in an embodiment.
Figure 8:
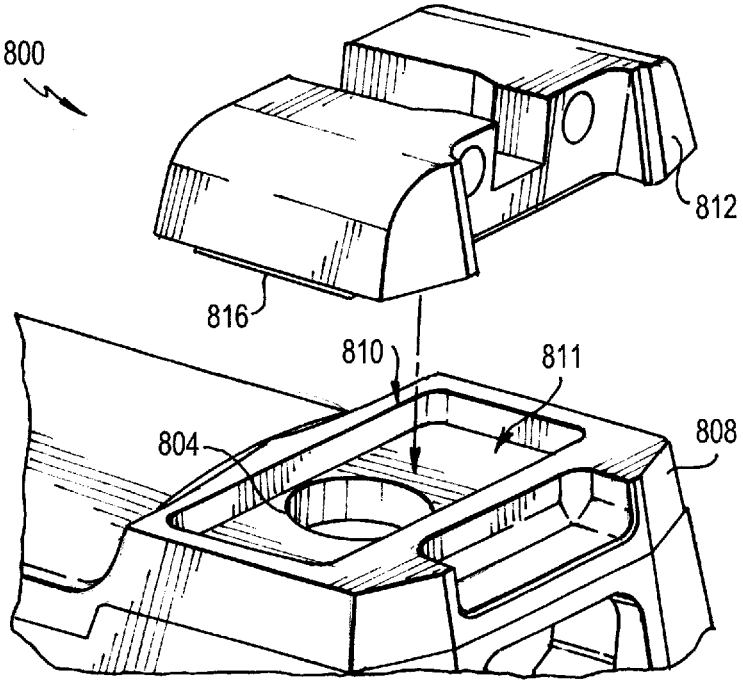
FIG. 8 is an exploded view of an alternative configuration of a rear sight configured for removable attachment to a removable mounting plate, in an embodiment.

Alternative configurations of the sight and the sight mounting slot are shown in FIG. 6B and FIG. 8. In the embodiment of FIG. 6B, the sight mounting slot can include an arcuate profile that corresponds to an arcuate cross sectional profile of the sight, although a dove tail configuration or other configuration may also be used. In the embodiment of FIG. 8, the sight mounting slot can be a recess in the mounting plate into which a corresponding salient feature of the sight fits. Descriptions of various embodiments of these components and their features are described below.

Figure 2:
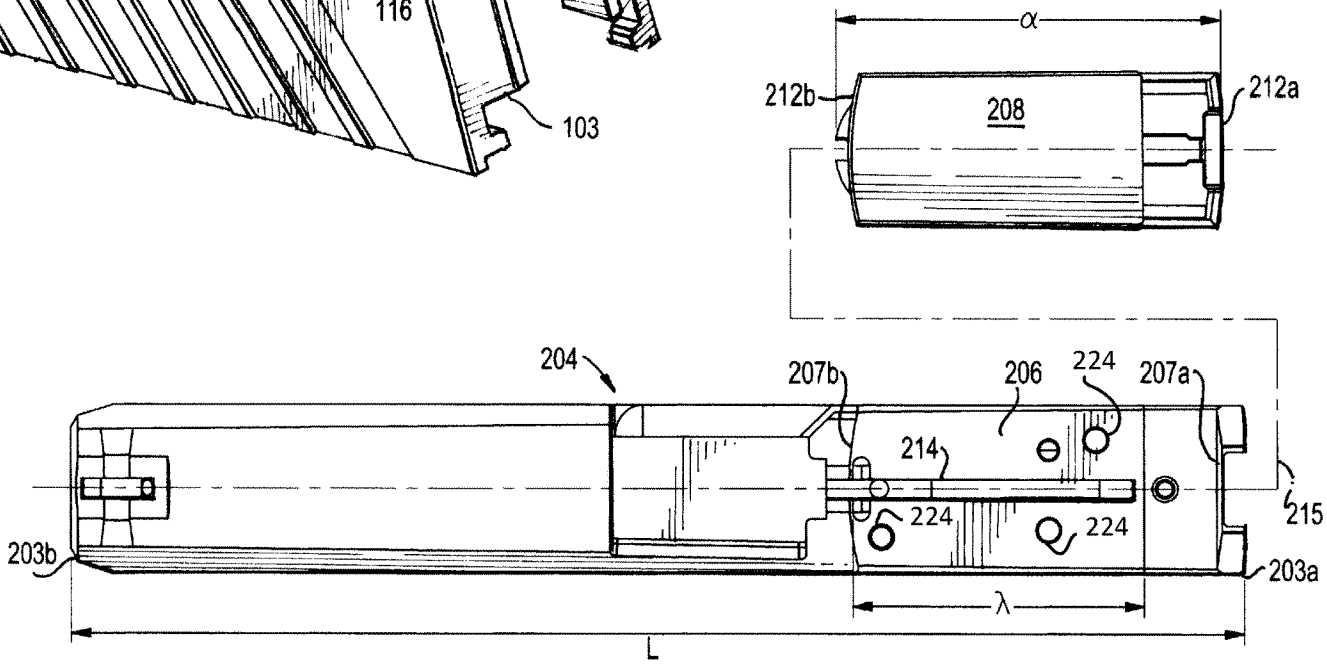
FIG. 2 is a plan view of an embodiment of a firearm slide and a corresponding mounting plate, in an embodiment.

The rear sight 120, configured for removable connection to the mounting plate 108 via the sight mounting slot 116, will also be described below in more detail Mounting Plate and Planar Mounting Surface of the Slide FIG. 2 illustrates an embodiment of slide 204 with corresponding mounting plate 208. This embodiment of the slide 204 includes a corresponding planar mounting surface 206. The planar mounting surface 206 includes a first end 207*a* proximate to a rear end 203*a* of the slide 204 (i.e., proximate to the user holding the firearm) and a second end 207*b* opposite the first end 207*a*. The second end 207*b* of the planar mounting surface 206 is disposed between the rear end 203*a* of the slide and a front end of the slide 203*b* adjacent to an opening of the firearm barrel (not shown).

A distance between the first end 207*a* of the planar mounting surface 206 and the second end 207*b* of the planar mounting surface 206 defines a length λ of the planar mounting surface. The length λ of the planar mounting surface 206 is less than the total length L of the slide 204. In embodiments, the percentage of the length L of the slide 204 occupied by the length λ of the planar mounting surface 206 is from 25% to 50%. In other embodiments, this percentage is from 30% to 40%. In other embodiments, this percentage is from 30% to 35%. In one embodiment, this percentage is 33%. The actual length λ of the planar mounting surface 206 is a function of the firearm on which the planar mounting surface 206 is disposed. For example, the planar mounting surface for a pistol can have any of the following lengths: 2 inches to 5 inches, from 2 inches to 4 inches, from 2 inches to 3 inches, from 2 inches to 2.5 inches, from 3 inches to 5 inches, from 3 inches to 4 inches, and from 4 inches to 5 inches. In one embodiment, a planar mounting surface 206 for a pistol is 2.43 inches long. In embodiments applicable to a long barreled firearm (e.g., a rifle or shotgun), the planar mounting surface can range from 2 inches to 5 inches, from 2 inches to 10 inches, from 5 inches to 10 inches, and any of the ranges previously described in the context of a pistol.

Also shown in the embodiment of the slide 204 are various (and in some examples at least two) mounting features for mounting an accessory or a corresponding embodiment of the mounting plate 208 directly to the planar mounting surface 206.

For example, each of the embodiments shown includes an axial groove 214 defined by the slide 204 in the planar mounting surface 206. The axial groove 214 is used as a mounting feature for a corresponding mounting plate 208 or an accessory (e.g., a red dot sight, a telescopic sight (not shown)). The axial groove 214 provides a line of contact between the slide 204 and the corresponding mounting plate 208 or accessory, thus improving the stability and repeatability of connection therebetween. As mentioned above, this further improves the versatility of a firearm by providing a mounting mechanism that needs fewer recalibrations (upon reattachment after a first calibration) or a less extensive recalibration process compared to accessories mounted to firearms with conventional mounting features.

The axial groove 214 extends at least partway between the first end 207*a* and the second end 207*b* of the planar mounting surface 206. In the embodiment shown, the axial groove 214 is oriented along a longitudinal axis 215 that corresponds to the slide 204. In other examples, one or more axial grooves 214 can be at any angle or angles with respect to the longitudinal axis 215.

Other mounting features shown on the planar mounting surface 206 of the slide 204 include various other mounting features 224 that can be used to mount various accessories having corresponding compatible mounting features.

Figure 3A:
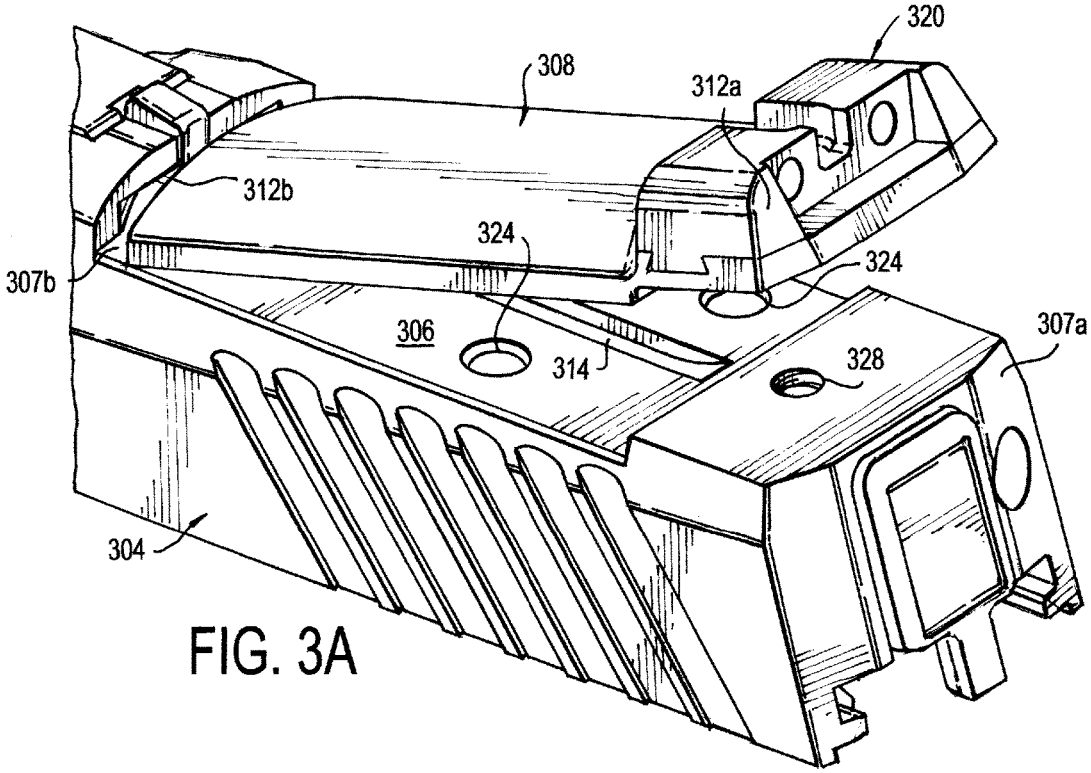
FIG. 3A is a perspective view of a removable mounting plate partially mounted on a planar mounting surface of a firearm slide, in an embodiment.
Figure 3A:
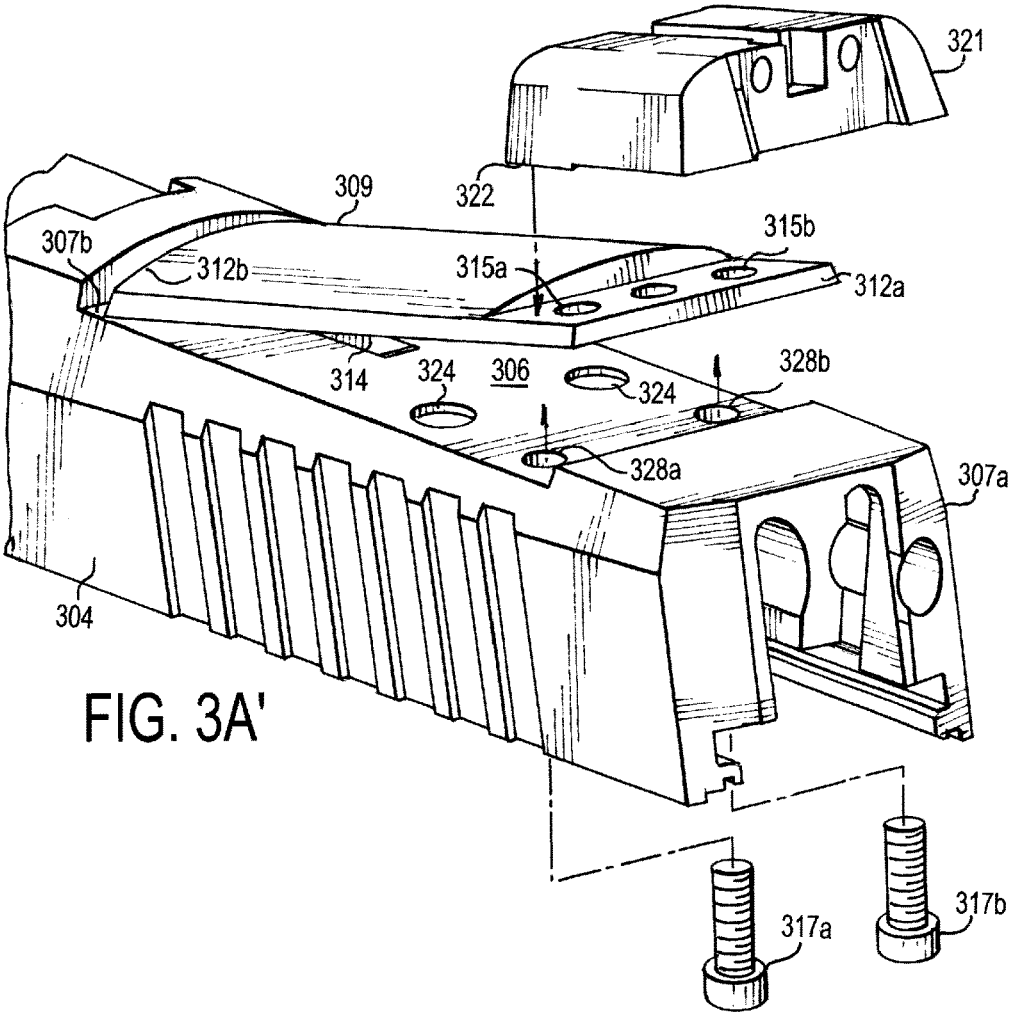

FIGS. 3A, 3A', and 3B each show perspective views of a removable mounting plate 308 partially mounted on a planar mounting surface of a firearm slide 304, in an embodiment.

The slide 304 includes a planar mounting surface 306 that further includes a first end 307*a* and a second end 307*b*. The planar mounting surface 306 of the slide 304 defines various mounting features to securely and repeatably mount accessories to the firearm. For example, as described above, the planar mounting surface 306 defines an axial groove 314 that is disposed between the first end 307*a* of the planar mounting surface and the second end 307*b* of the planar mounting surface. This axial groove 314 is used to mount a corresponding feature of the mounting plate 308 (or other accessory in other embodiments) to the slide 304. The axial groove 314 can also be used to repeatably mount an accessory (such as a red dot sight or a flashlight, neither of which are shown) to the slide 304 so as to minimize the need for recalibration (colloquially known as "re-sighting") upon re-mounting a previously mounted and removed accessory. In addition to the axial groove 314, the planar mounting surface 306 defines various other mounting features 324 that can be used to mount various accessories having corresponding compatible mounting features.

The slide 304 also defines a threaded hole 328 that is used to secure the slide 304, the mounting plate 308 and a rear sight 320 together. In an alternative embodiment, the slide 304 can define two threaded holes 328*a* and 328*b*, as shown in FIG. 3A'. Furthermore, in the embodiment of FIG. 3A', it will be noted that the two threaded holes 328*a* and 328*b* can be defined by a portion of the planar mounting surface 306 that is proximate to the other mounting features 324 and the axial groove 314. This is unlike the embodiment shown in FIGS. 3A and 3B, where the threaded hole 328 is defined by a raised portion at the first end 307*a* of the planar mounting surface 306. Furthermore, in the embodiment of FIG. 3A', the screws 317*a* and 317*b* engaged with threaded holes 328*a*, 328*b*, pass through corresponding through holes 315*a*, 315*b*, and engage corresponding threaded holes (not shown) in an underside surface 322 of the rear sight 321 that overlaps with the first end 312*a* of the removable mounting plate 309. Regardless, the connections between the slide 304, mounting plate 306 and rear sight 320 are discussed below in more detail. The size of the threaded hole 328 (or at least one threaded holes 328*a*, 328*b*) and the corresponding threading can be any configuration convenient for the connection of these elements, and need not be described.

The mounting plate 308 includes a first end 312*a* and a second end 312*b*. The mounting plate 308 also is configured to receive a removably connectable rear sight 320, described below in more detail in the context of FIGS. 5, 6, and 7.

Figure 3B:
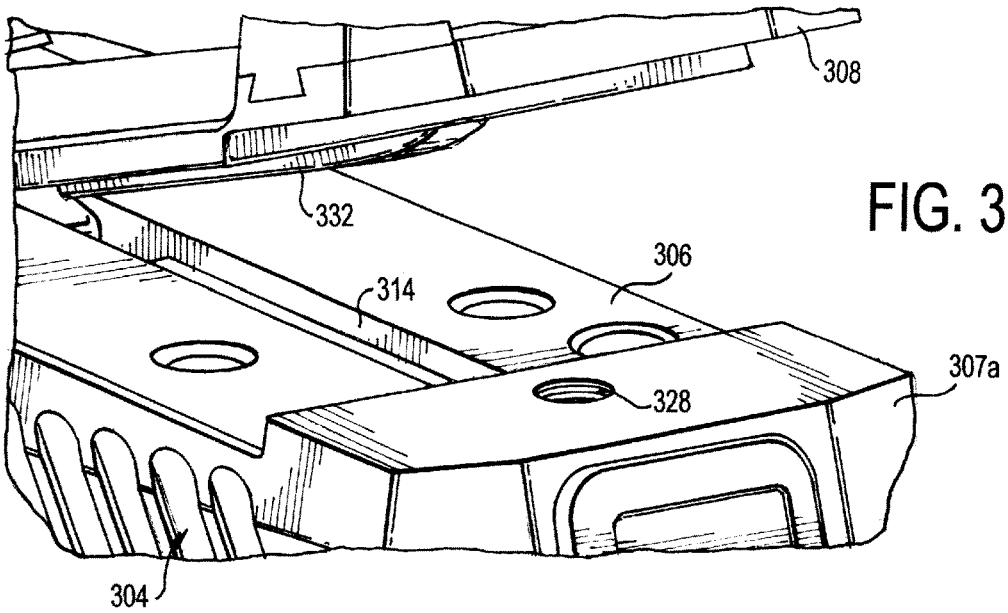
FIG. 3B is a magnified perspective view of the removable mounting plate partially mounted to the planar mounting surface of the firearm slide shown in FIG. 3A, in an embodiment.

FIG. 3B illustrates a view of an underside of the mounting plate 308 and a portion of the planar mounting surface proximate 306 to the first end 307*a* in more detail. The various features shown in FIG. 3B, and shown in more detail in FIGS. 4 and 5 include mounting features for mounting an accessory to the mounting plate 308 so that the connection is stable (e.g., not prone to unintentional or unpredictable movement) and repeatable (e.g., eliminating or reducing need for recalibration after a removed accessory has been remounted).

In particular, FIG. 3B depicts an axial mounting rib 332 on the mounting plate 308. This axial mounting rib 332 is configured to be placed with in the axial groove 314 defined in the planar mounting surface 306 of the slide 304. Upon placement of the axial mounting rib 332 in the axial groove 314, a line of contact is formed between the planar mounting surface 306 of the slide 304 and the mounting plate 308, or between an accessory having a compatible axial mounting rib. This line of contact improves the stability and repeatability of connection between the slide 304 and an attached accessory (and the mounting plate 308) compared to connections that are based on discrete points.

Figure 4:
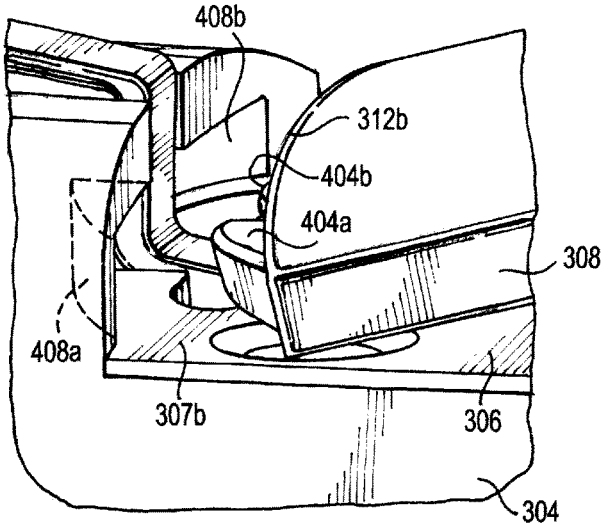
FIG. 4 is a view of a forward mounting tab of a removable mounting plate engagable with a mounting pocket defined by a firearm slide, in an embodiment.
Figure 5:
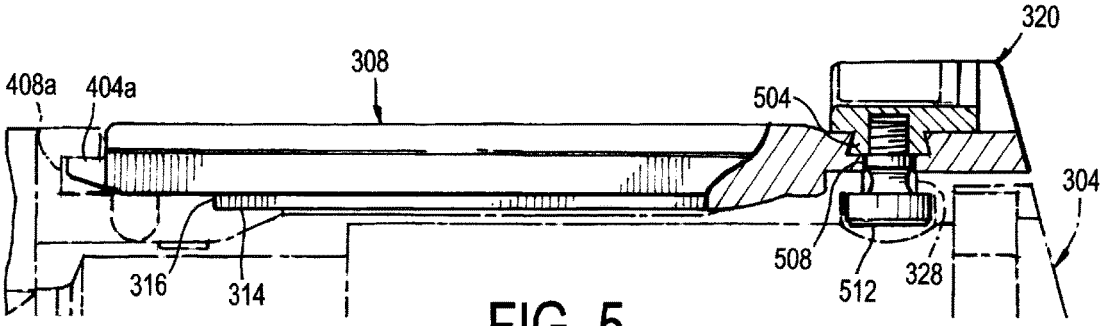
FIG. 5 is a transparent side view of a firearm slide assembly, in an embodiment.

FIGS. 4 and 5 illustrate additional mounting features used to secure the mounting plate 308 (accessory) to the planar mounting surface 306 of the slide 304. FIG. 4 illustrates a connection between a second end 312*b* of the mounting plate 308 and a corresponding second end 307*b* of the planar mounting surface 306. This connection is facilitated by forward mounting tabs 404*a* and 404*b* (collectively 404) at the second end 312*b* of the mounting plate 308. The forward mounting tabs 404 are configured to be received by, and removably connect within, corresponding mounting pockets 408*a* and 408*b* (collectively 408) that are defined by the slide 304 and disposed proximate to the second end 307*b* of the planar mounting surface 306. In embodiments, the forward mounting tabs 404 may actually include greater or fewer numbers of forward mounting tabs that the two shown in FIG. 4, each of which is configured to removably connect to corresponding mounting pockets defined by the slide 304.

FIG. 5 is a transparent side view of a firearm slide assembly, in an embodiment, and illustrates the various points of connection between the mounting plate 308 and the slide 304 when the mounting plate 308 is fully engaged with and mounted to the slide 304. Elements previously described are also shown in FIG. 5. For example, the mounting plate 308 is mounted on the slide 304. As described above, the forward mounting tabs 404 are engaged in the corresponding mounting pockets 408. The axial mounting rib 316 of the mounting plate 308 is disposed within the axial groove 314. A screw 512 (having at least a threaded portion and optionally a knurled grip, a phillips-head, straight, or hex-head impression) has been threaded through the threaded hole 328, passing through a through-hole 508 in the mounting plate 308, and threaded into a threaded hole 328 in the rear sight 320. The benefits of this configuration have been described above.

Removable Rear Sight

FIG. 6A illustrates in more detail an embodiment of the mounting plate 108 of FIG. 1 configured to receive the rear sight 120. From the perspective shown in FIG. 6A, the mounting plate 108 defines two features to which rear sight 120 removably mounts to the mounting plate and removably connects to the slide 304: the sight mounting slot 116 (also indicated in FIG. 1) and a through-hole 508.

The embodiment of the sight mounting slot 116 shown is configured to receive a corresponding dovetail shaped mounting bar 124 on the rear sight 120. Using the sight mounting slot 116 and a compatible mounting bar (e.g., dovetail shaped mounting bar 124), various configurations of a rear sight (in addition to the embodiment of the rear sight 120 shown in FIGS. 1 and 6A) can be conveniently inserted and removed from the mounting plate. For example, an alternative configuration of a rear sight includes a removable sight that engages and disengages from a first end 112*a* of the mounting plate 108 parallel to the longitudinal axis of the slide (e.g., longitudinal axis 215 shown in FIG. 2), such as the one shown in FIG. 6B.

Figure 7:
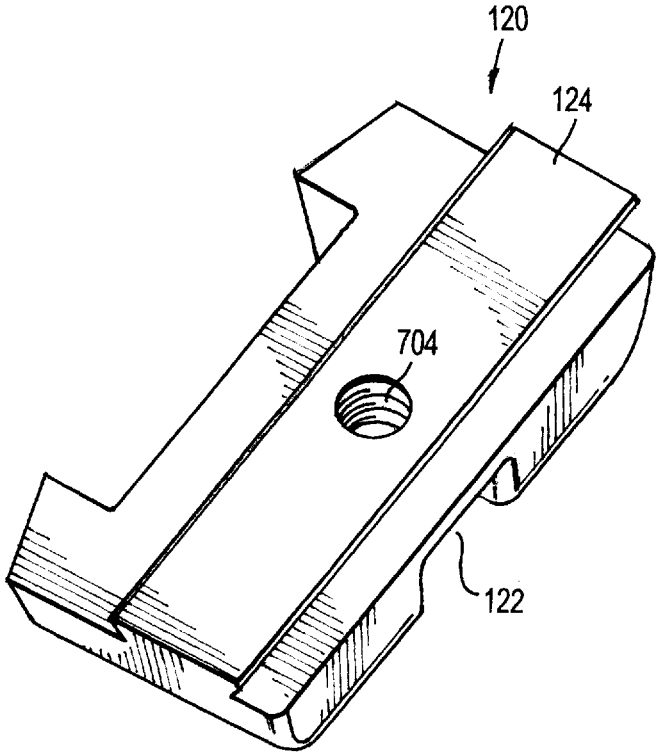
FIG. 7 is a view of an underside of a rear sight, which includes a threaded hole that is configured to engaged with a screw, in an embodiment.

The through-hole 508 defined by the mounting plate 108 is located within the sight mounting slot 116 of the mounting plate 108 so as to correspond to the location of the threaded hole 328 of the slide 304 and a threaded hole in the rear sight 120 (analogous to the threaded hole 328 indicated in FIG. 5 and as shown in more detail in FIG. 7). By sliding the rear sight 120 so that each of the threaded holes and through-holes are aligned, any rear sight can be conveniently removed and replaced with another configuration of a rear sight or another type of accessory. Furthermore, because of the alignment of these various holes that is maintained through the use of a screw, the need for re-sighting or re-aligning a mounted accessory is reduced. The embodiment of the rear sight 120 defines a sighting notch 122 and includes two tritium vials 612*a* and 612*b* (collectively 612). The sighting notch 122 is aligned with a front sight (not shown), both of which are aligned with a target.

The tritium vials 612 facilitate sighting the firearm in low light conditions because the decay of tritium can, when paired with an appropriate material, luminesce. The two tritium vials 612*a* and 612*b*, when luminescing can be aligned with a similar tritium vial on a front sight, thus enabling alignment of the front and rear sights in low light conditions.

FIG. 7 is a view of an underside of the rear sight 120, which includes a threaded hole 704 that is configured to engaged with a screw or other fastener. As described above, the threaded hole 704 is used to establish alignment between the slide 304, the mounting plate 308, and the rear sight 120, which is then maintained by a screw or other fastener.

FIG. 8 is an exploded view of an alternative configuration of a rear sight configured for removable attachment to a removable mounting plate, in an embodiment. In this embodiment, the mounting plate 808 includes a peripheral ridge 810 that defines a recess 811 therein (and that includes through hole 804). A corresponding salient feature 816 on the rear sight 812 is designed and configured to mate with the recess 811 so that the rear sight 812 can be repeatedly removed and replaced with little or no recalibration. As will be understood from the preceding description, a threaded hole (not shown) in the underside of the salient feature 816 is present to engage a screw passing through a corresponding threaded hole in the slide, and the through hole 804. It will be appreciated that while rectangular recess 811 and salient feature 816 are shown here, any shape or configuration (circular, square, multiple cylinders and corresponding recesses, etc.) can be used with the same result of convenient and repeatable removal and replacement.

Other embodiments of the rear sights are also compatible with the embodiments described above.

Further Considerations

The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the invention, which is set forth in the following claims.

What is claimed is:

1. A firearm comprising:

a barrel;

a firing chamber in mechanical communication with the barrel;

a slide disposed over the barrel and firing chamber, the slide having a rear end and a front end opposite the rear end, the slide comprising:

a planar mounting surface having a first end, and a second end opposite the first end, the first end of the planar mounting surface at the rear end of the slide and the second end of the planar mounting surface between the rear end of the slide and the front end of the slide;

at least two mounting features defined by the planar mounting surface;

a mounting pocket defined by the slide, the mounting pocket proximate to the second end of the planar mounting surface;

a mounting plate comprising:

a first end defining a sight mounting slot, the first end disposed at the first end of the planar mounting surface;

a second end opposite the first end, the second end comprising a forward mounting tab configured to mount within the mounting pocket defined by the slide at the second end of the planar mounting surface; and an axial mounting rib extending between the first end of the mounting plate and the second end of the mounting plate along a longitudinal axis of the mounting plate.

2. The firearm of claim 1, wherein a length of the planar mounting surface between the first end and the second end is at least 30% of a length of the slide.

3. The firearm of claim 1, wherein a length of the planar mounting surface between the first end and the second end is at least 33% of a length of the slide.

4. The firearm of claim 1, further comprising a rear sight defining a sighting notch, the rear sight comprising a mounting surface configured to fit within the sight mounting slot of the first end of the mounting plate.

5. The firearm of claim 4, wherein the rear sight mounting surface is a salient feature configured to fit within a corresponding recess defined by the first end of the mounting plate.

6. The firearm of claim 4, wherein one mounting feature of the at least two mounting features defined by planar mounting surface comprises:

at least one first threaded hole defined by the slide, the at least one first threaded hole corresponding to at least one through-hole defined by the mounting plate and also corresponding to at least one second threaded hole defined by the rear sight.

7. The firearm of claim 6, further comprising at least one screw configured to be threaded through the corresponding at least one first threaded hole defined by the slide, disposed in the at least one through-hole, and threaded to the corresponding at least one second threaded hole defined by the rear sight.

8. The firearm of claim 1, wherein one mounting feature of the at least two mounting features comprises an axial groove defined by the planar mounting surface of the slide, the axial groove extending between the first end of the planar mounting surface and the second end of the planar mounting surface, wherein the axial groove is dimensioned and configured to receive the axial mounting rib.

9. A firearm slide having a rear end and a front end, the firearm slide comprising:

a planar mounting surface having a first end, and a second end opposite the first end, the first end of the planar mounting surface at the rear end of the slide and the second end of the planar mounting surface between the rear end of the firearm slide and the front end of the firearm slide;

at least two mounting features defined by the planar mounting surface;

a mounting pocket defined by the planar mounting surface, the mounting pocket proximate to the second end of the planar mounting surface;

a removable mounting plate comprising:

a first end defining a sight mounting slot, the first end disposed at the first end of the planar mounting surface;

a second end opposite the first end, the second end comprising a forward mounting tab configured to mount within the mounting pocket defined by the firearm slide at the second end of the planar mounting surface; and an axial mounting rib extending between the first end of the mounting plate and the second end of the mounting plate along a longitudinal axis of the mounting plate.

10. The firearm slide of claim 9, wherein a first mounting feature of the at least two mounting features comprises an axial groove defined by the planar mounting surface and extending along a longitudinal axis of the firearm slide and between the first end and the second end of the planar mounting surface, wherein the axial groove is dimensioned and configured to receive the axial mounting rib.

11. The firearm slide of claim 9, wherein a length of the planar mounting surface between the first end and the second end is at least 30% of a length of the firearm slide.

12. The firearm slide of claim 9, wherein a length of the planar mounting surface between the first end and the second end is at least 33% of a length of the firearm slide.

13. The firearm slide of claim 9, wherein a second mounting feature of the at least two mounting features comprises at least one first threaded hole defined by the firearm slide disposed proximate to the rear end of the firearm slide.

* * * * *